US008162294B2

(12) United States Patent
Scott

(10) Patent No.: US 8,162,294 B2
(45) Date of Patent: Apr. 24, 2012

(54) WATER CARBONATION APPARATUS

(75) Inventor: John Scott, Cambridge (GB)

(73) Assignee: Ludgate 332 Ltd, London (GB)

( * ) Notice: Subject to any disclaimer, the term of this patent is extended or adjusted under 35 U.S.C. 154(b) by 732 days.

(21) Appl. No.: 12/297,539

(22) PCT Filed: Apr. 17, 2007

(86) PCT No.: PCT/GB2007/001388

§ 371 (c)(1),
(2), (4) Date: Dec. 16, 2008

(87) PCT Pub. No.: WO2007/129010

PCT Pub. Date: Nov. 15, 2007

(65) Prior Publication Data

US 2009/0121364 A1 May 14, 2009

(30) Foreign Application Priority Data

Apr. 21, 2006 (GB) ..... 0607979.2

(51) Int. Cl.
*B01F 3/04* (2006.01)

(52) U.S. Cl. ..... 261/49; 261/66; 261/82; 261/DIG. 7

(58) Field of Classification Search ..... 261/82, 261/44.1, 49, 53, 58, 62, 66, 67, DIG. 7
See application file for complete search history.

(56) References Cited

U.S. PATENT DOCUMENTS 3,851,797 A * 12/1974 Jacobs ..... 222/129.4
4,822,531 A * 4/1989 Rudick et al. ..... 261/25
4,839,107 A 6/1989 Rudick et al.
4,859,376 A * 8/1989 Hancock et al. ..... 261/35
4,889,662 A * 12/1989 Smith ..... 261/35
4,927,567 A 5/1990 Ridick
5,139,708 A * 8/1992 Scott ..... 261/23.1
6,231,322 B1 5/2001 Adolfsson
6,672,481 B2 * 1/2004 Ziesel ..... 222/129.1

OTHER PUBLICATIONS

PCT/GB2007/001388, International Search Report, International Searching Authority, Aug. 28, 2007.
PCT/GB2007/001388, Written Opinion , International Searching Authority, Aug. 28, 2007.

* cited by examiner

*Primary Examiner* — Charles Bushey
(74) *Attorney, Agent, or Firm* — RatnerPrestia

(57) ABSTRACT

There is described a water carbonation apparatus in which two carbonation units (10, 11) are linked to a volumetric control unit (9) which stores a volume of carbonated water ready for use. When carbonated water is to be discharged, the stored carbonated water from the volumetric control unit (9) is discharged, while simultaneously carbonated water from one of the carbonation units (10, 11) is discharged into the other carbonation unit (11, 10) is filled with uncarbonated water from the volumetric control unit (9), and a volume of uncarbonated water is drawn from a water supply (2) into the volumetric control unit. The volumetric control unit (9) in one embodiment comprises a pair of piston and cylinder assemblies which together define four internal chambers (21, 22, 23, 24), the pistons being linked together such that the volumes of the four internal chambers vary at the same rate.

14 Claims, 8 Drawing Sheets

WATER CARBONATION APPARATUS

CROSS-REFERENCE TO RELATED APPLICATIONS

Figure 1:
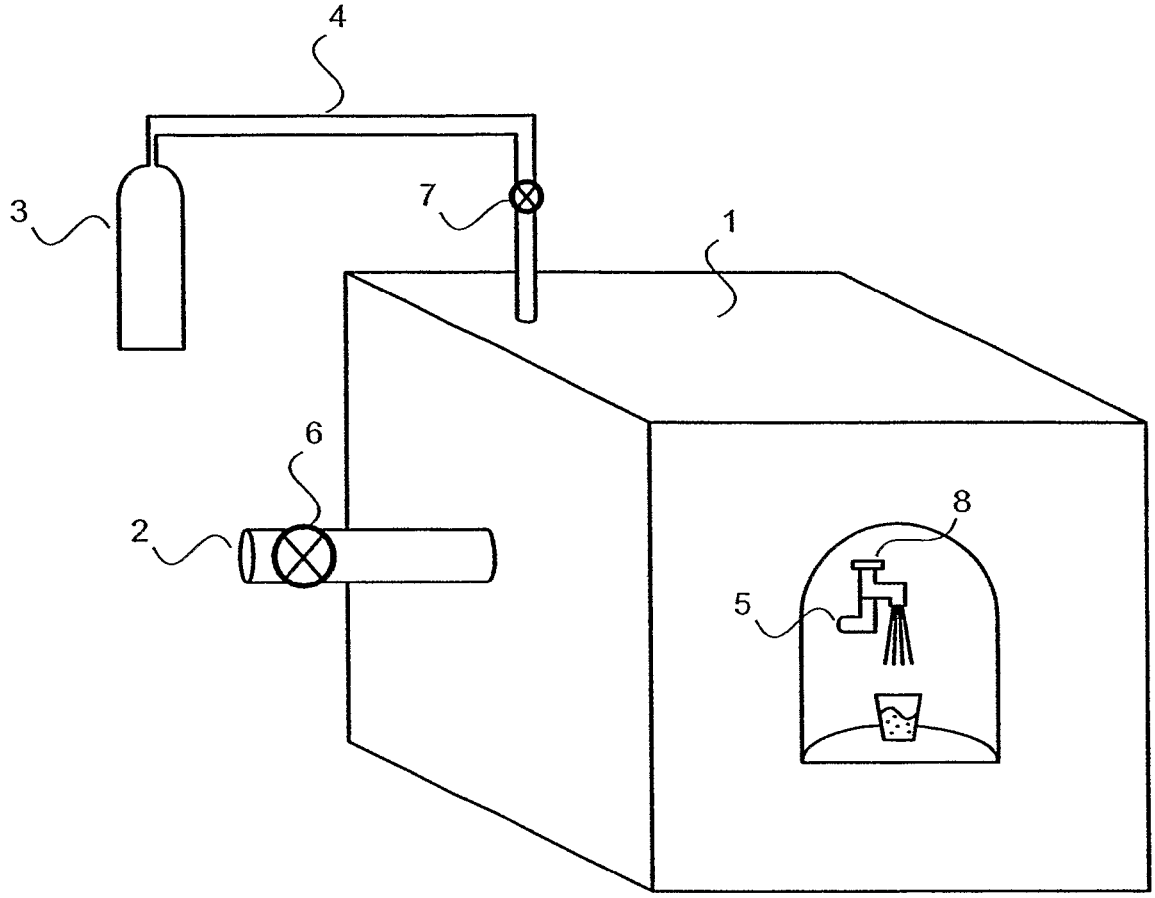

This application is the U.S. National Phase application of PCT International Application No. PCT/GB2007/001388, filed Apr. 17, 2007, and claims priority to Great Britain Patent Application No. 0607979.2, filed Apr. 21, 2006, the disclosures of which are incorporated herein by reference in their entirety for all purposes.

The present invention relates to an improved system and apparatus for the carbonation of water.

Various types of carbonator for carbonating water are known. One such carbonator is the well known "Sodastream" (RTM) carbonator as disclosed in UK patent 1453363. This carbonator comprises an initially un-pressurised container that contains the water to be carbonated and a nozzle through which $CO_2$ can be introduced placed below the water surface. The carbonation process is performed by bubbling $CO_2$ through the water from the nozzle. However, not all the $CO_2$ is absorbed in the water and waste $CO_2$ bubbles through the water and collects in the headspace of the container, and building up to a pressure of approximately 13 to 15 bar. Once the carbonation process is complete, the waste $CO_2$ is discharged into the atmosphere to depressurise the container, and the carbonated water is dispensed under gravity. If more carbonated water is required then the carbonation process must be repeated. Alternatives to this system are known where, for example, the carbonated water is dispensed under gas pressure or by incoming mains water rather than by gravity. In both of these alternatives, however, a large volume of $CO_2$ is discharged to atmosphere after each batch of carbonated water is produced.

Another known carbonator is the "Isoworth" carbonator as disclosed in UK patent 2161089. This carbonator comprises an initially un-pressurised container that is partially filled with water, and a vaned rotor within the container is driven in rotation about a substantially horizontal axis so that the vanes break the water surface. An inlet port is formed at the top of the container, through which $CO_2$ can be introduced to pressurise the container up to about 6 to 8 bar. The carbonation process is carried out by firstly introducing $CO_2$ into the headspace between the water surface and the top of the container. The water is then agitated by rotating the rotor, splashing water into the pressurised $CO_2$ in the headspace and drawing $CO_2$ into the water. This system has the advantage that it operates with the $CO_2$ in the headspace at a lower pressure than the "Sodastream" carbonator described above. The carbonated water is discharged from the carbonator by releasing the gas pressure and allowing the carbonated water out of an outlet port at the bottom of the container. Again, a large volume of gas is vented to atmosphere after each batch of carbonated water is prepared.

Both the above systems have the disadvantage that $CO_2$ must be discharged to the atmosphere at the end of the carbonation cycle. A further disadvantage of both the above systems is that carbonation can only be performed on a batch basis.

A further known carbonator comprises a container containing $CO_2$ that is maintained under pressure and a high pressure pump operable to spray water into the container. The carbonation process is performed by spraying or bubbling water into the container using the high pressure pump. The carbonated water is then dispensed under pressure. This system has the advantage that no $CO_2$ is discharged as part of the carbonation process other than during a periodic venting process to remove accumulated air. It has the further advantage that it can give a continuous supply of carbonated water. However, the high pressure pump that is used in such a system is very expensive and therefore this system is only commonly used in commercial carbonation processes.

One aim of the present invention is to provide an improved carbonation system that does not use an expensive high pressure pump, can still provide a substantially continuous supply of carbonated water, and does not discharge large amounts of $CO_2$ to the atmosphere after each use.

According to one aspect of the invention, there is provided an apparatus for producing a supply of carbonated water, comprising:

supply means for receiving a supply of uncarbonated water;

discharge means for discharging carbonated water;

a first carbonating unit having a charging inlet for uncarbonated water and a delivery outlet for carbonated water;

a second carbonating unit having a charging inlet for uncarbonated water and a delivery outlet for carbonated water; and a volumetric control unit, operable in a first mode:

to receive a volume of carbonated water from the delivery outlet of the first carbonating unit, to receive a volume of uncarbonated water from the supply means, to deliver a volume of uncarbonated water to the second carbonating unit and to deliver a volume of carbonated water to the discharge means;

and operable in a second mode:

to receive a volume of carbonated water from the delivery outlet of the second carbonating unit, to receive a volume of uncarbonated water from the supply means, to deliver a volume of uncarbonated water to the first carbonating unit and to deliver a volume of carbonated water to the discharge means.

Figure 2A:
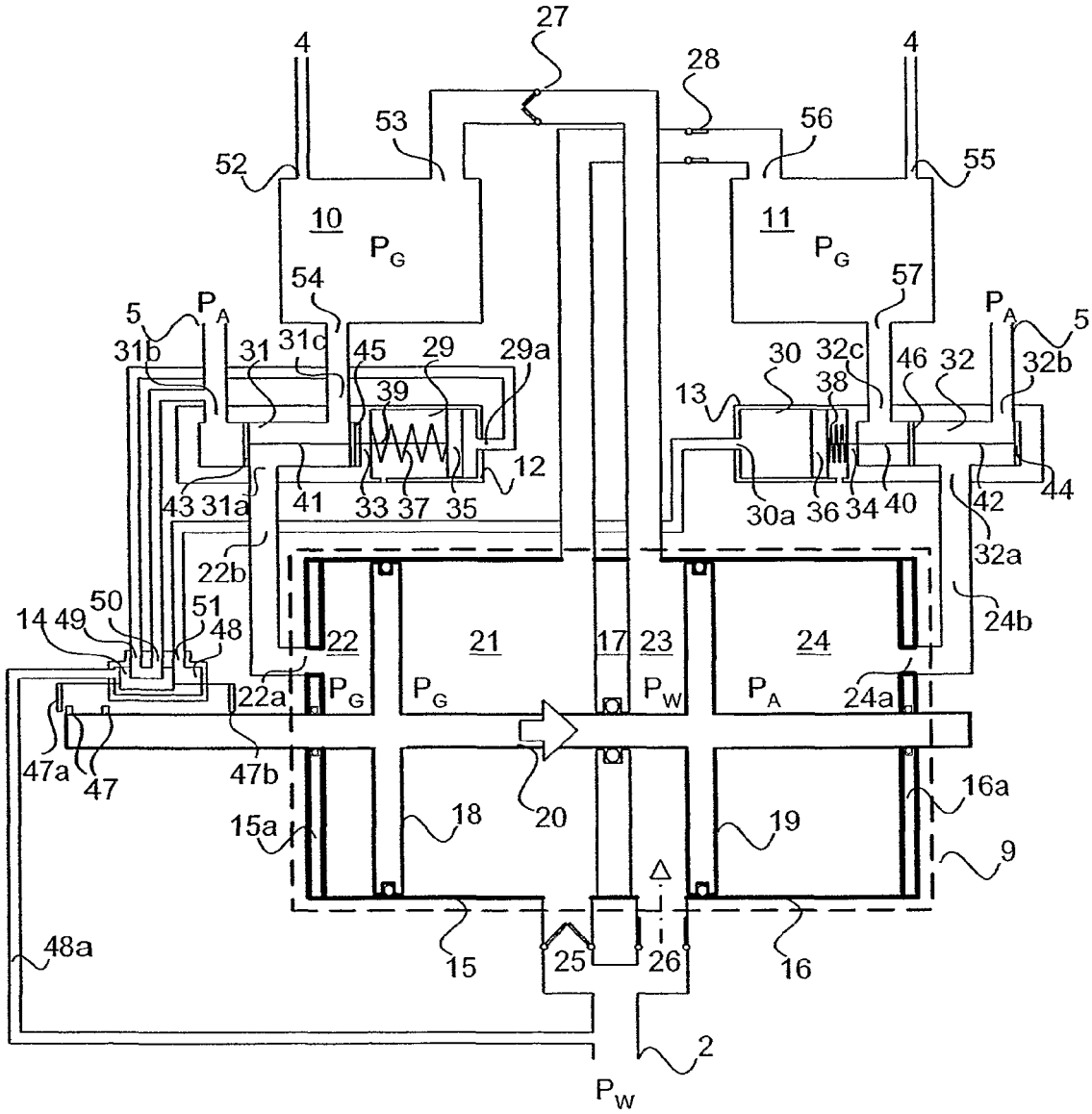
Figure 2B:
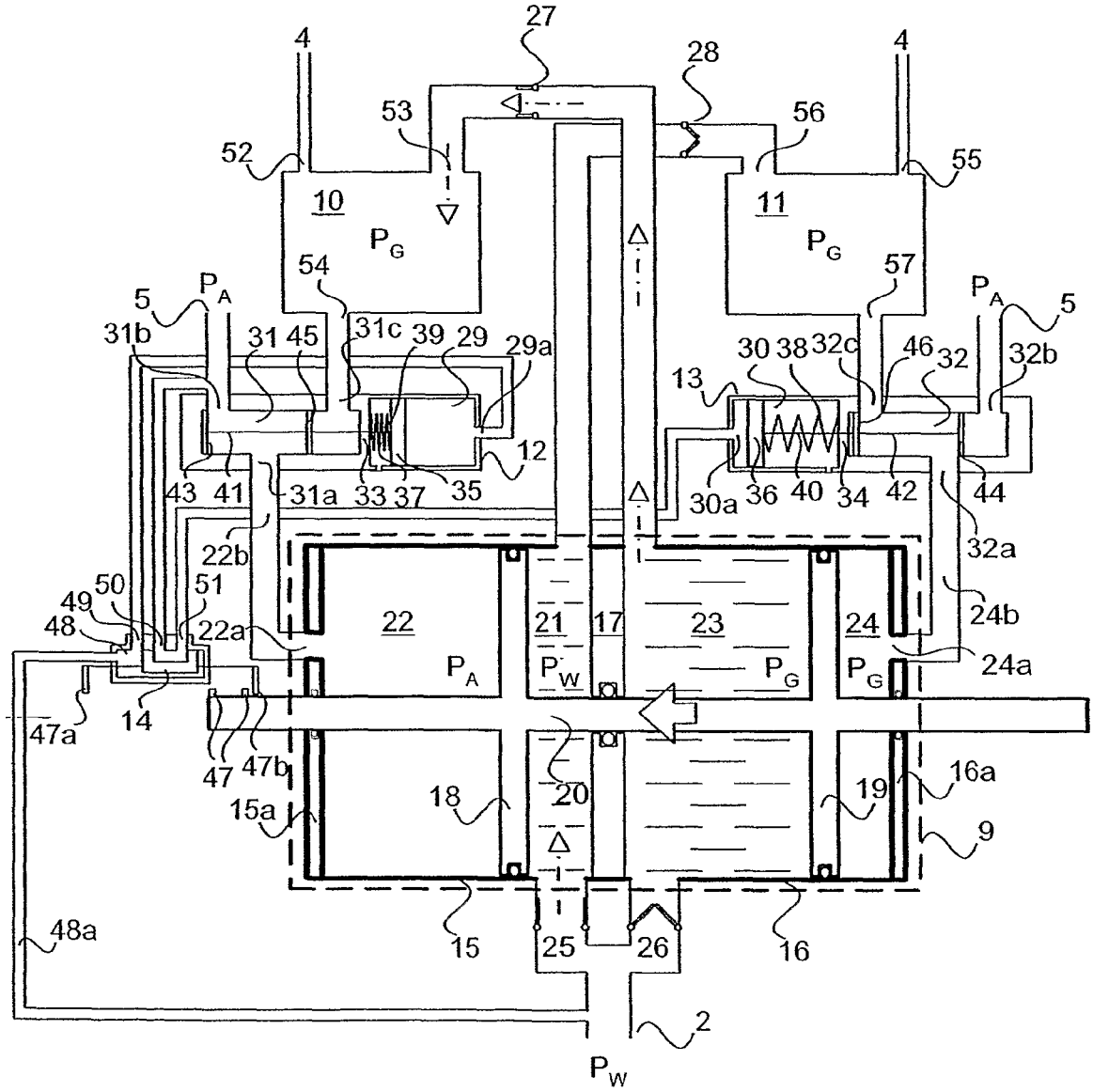
Figure 2C:
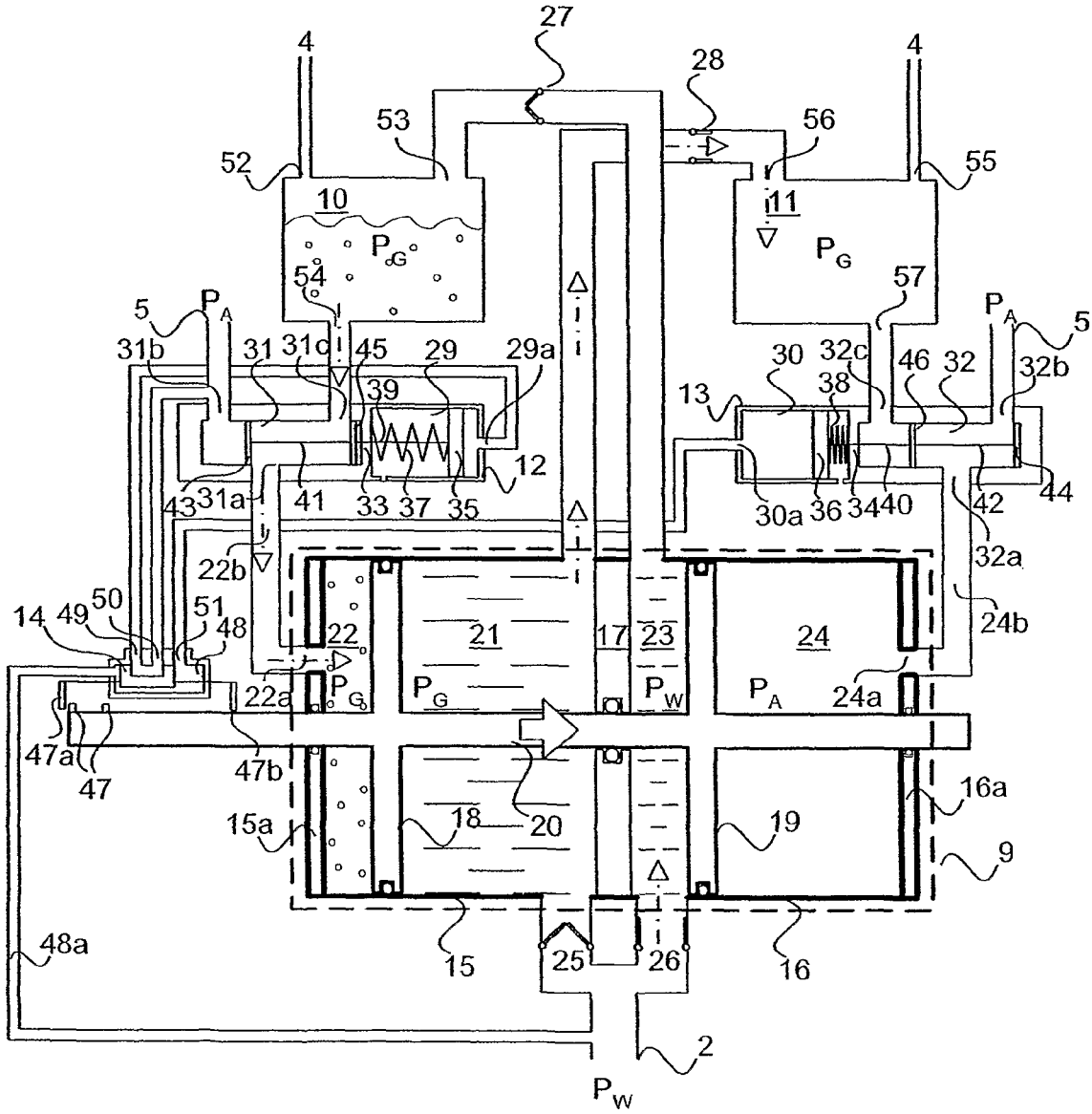
Figure 2D:
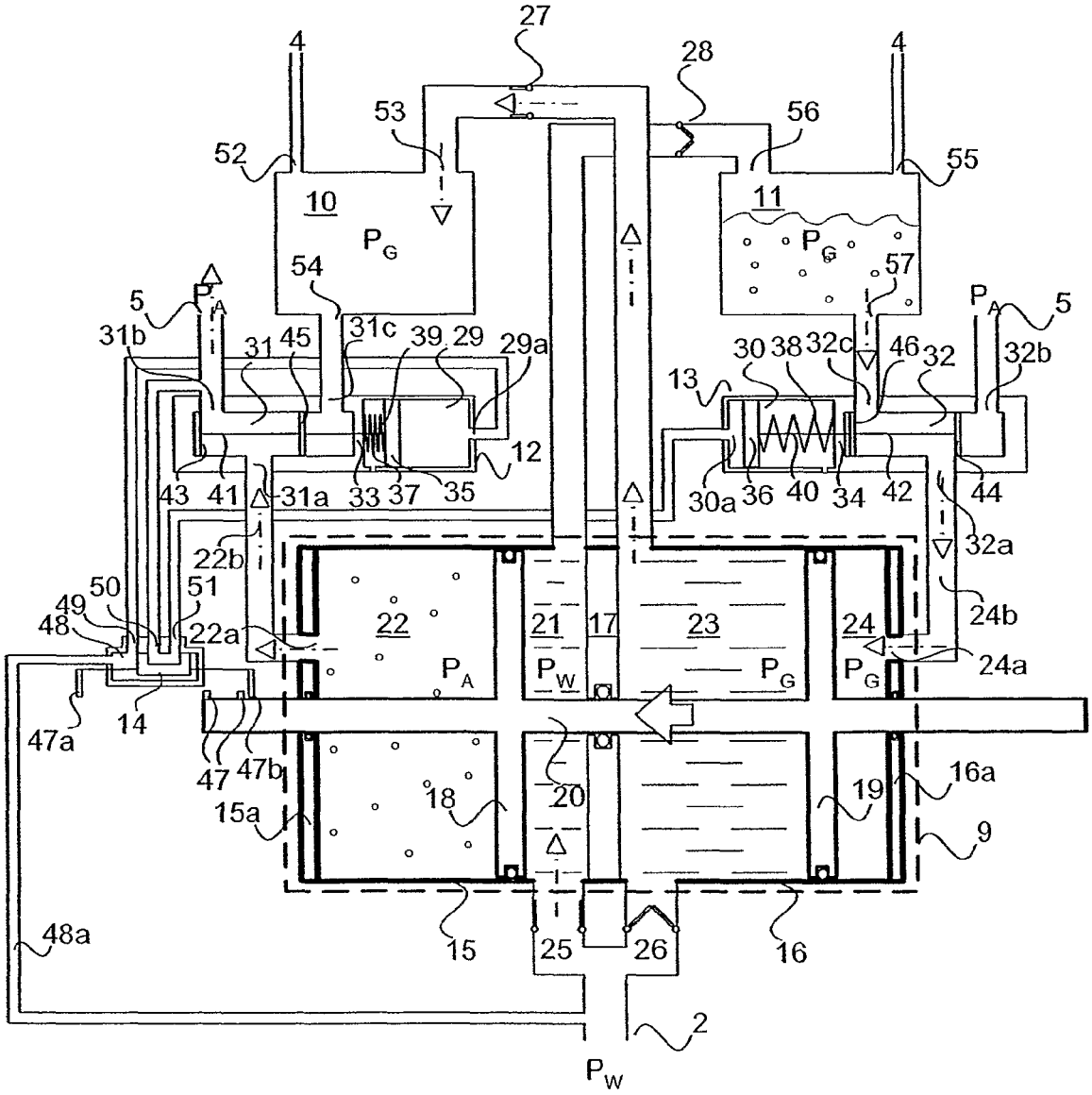
Figure 2E:
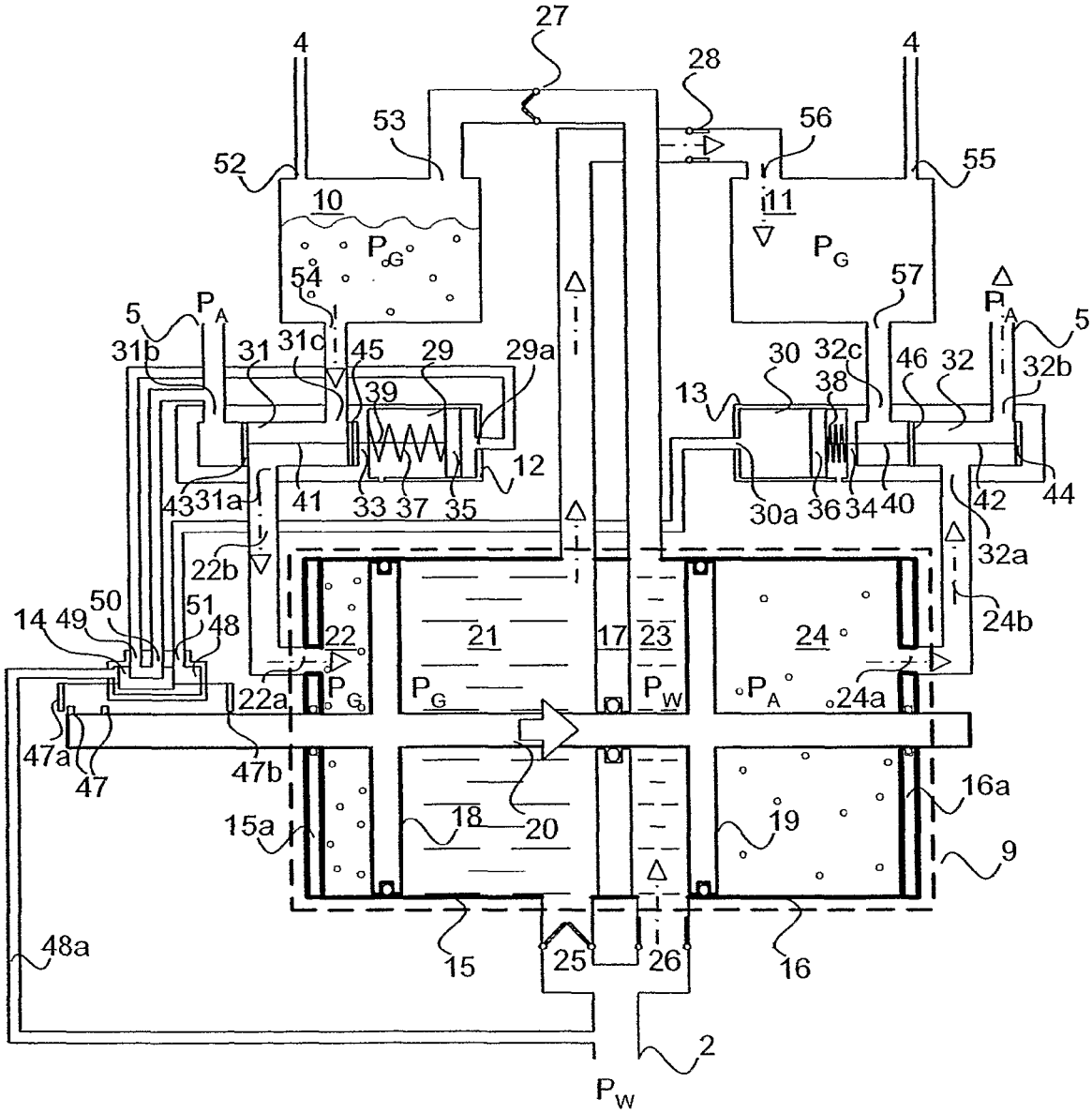
Figure 3A:
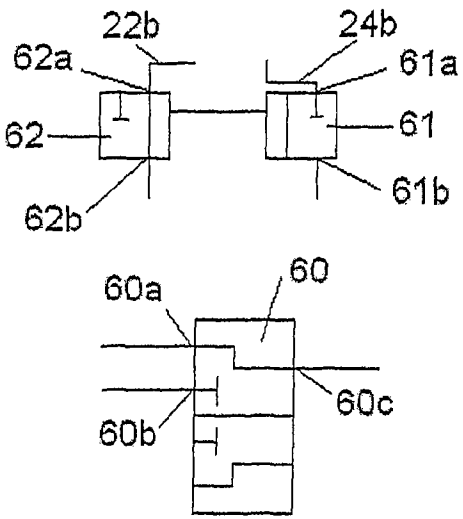
Figure 3:
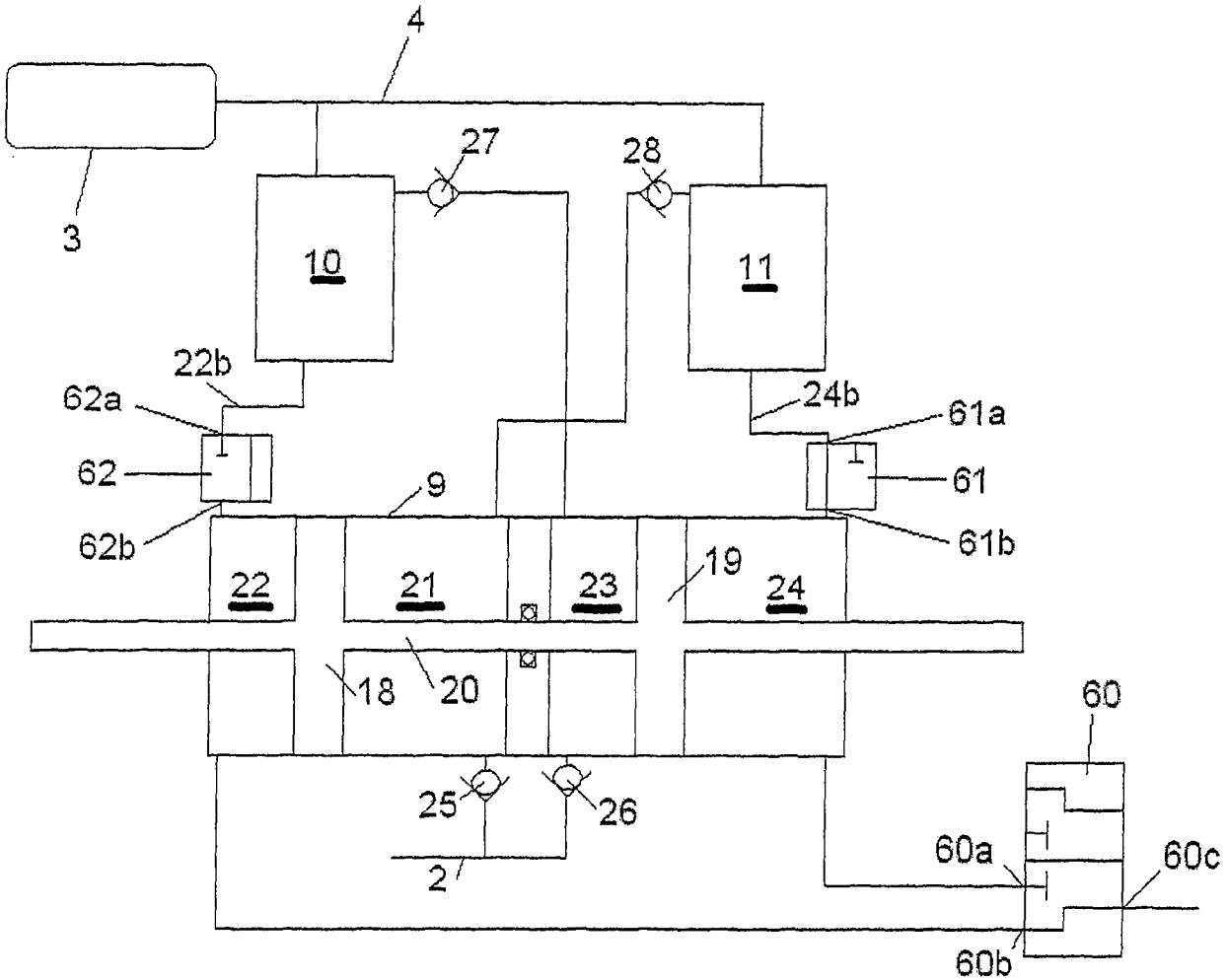

Embodiments of the invention will now be described with reference to the accompanying drawings in which:

FIG. 1 is a schematic diagram illustrating a drinks dispensing system that is used to dispense carbonated drinks;

FIG. 2*a* is a schematic diagram illustrating the components of a carbonation unit forming part of the drinks dispensing system shown in FIG. 1, in an initial state of an operating cycle;

FIG. 2*b* is a schematic diagram illustrating the components of the carbonation unit of FIG. 2, in a second state of the operating cycle;

FIG. 2*c* is a schematic diagram illustrating the components of the carbonation unit in a third state of the operating cycle;

FIG. 2*d* is a schematic diagram illustrating the components of the carbonation unit in a fourth state of the operating cycle;

FIG. 2*e* is a schematic diagram illustrating the components of the carbonation unit in a fifth state of the operating cycle;

FIGS. 3 and 3*a* illustrate an alternative valve arrangement for the carbonator apparatus of FIGS. 2*a* to 2*e*, including a two-position discharge valve; and FIGS. 4*a* to 4*d* illustrate a modified valve arrangement, similar to that shown in FIG. 3, but including a three-position discharge valve.

FIG. 1 schematically illustrates a drinks dispensing system used in an embodiment of the present invention. As shown, the drinks dispensing system comprises a carbonation unit 1 for carbonating water, a pipeline 2 connected to a water supply, for supplying water to the carbonation unit, a reservoir 3 for storing pressurised $CO_2$, a pipeline 4 connecting the $CO_2$ reservoir to the carbonation unit and a dispense line 5 leading to a tap 8 for dispensing carbonated water.

In the illustrated embodiment flow control valves 6 and 7 are fitted to the mains water pipeline 2 the $CO_2$ pipeline 4, respectively, to open or close the respective lines.

FIGS. 2*a* to 2*e* illustrate a carbonation unit 1, which comprises a volumetric control unit 9, left and right carbonators 10 and 11 connected to the volumetric control unit 9, left and right servo valves 12 and 13 to open and close connections between the carbonators and the volumetric control unit 9, and a two position slide valve 14 operable to control the operation of the servo valves 12 and 13. Where the expressions "left" and "right" are used in the description, these refer to left and right as shown in FIGS. 2*a* to 2*e*, and should not be construed as limiting. Likewise, although the volumetric control unit 9 is shown with its longitudinal axis horizontal, it is to be understood that the unit may be placed in any orientation.

The volumetric control unit 9 comprises left and right coaxial cylinders 15 and 16 separated by a central fixed partition 17. The ends of the cylinders 15 and 16 remote from the partition 17 are closed by end caps 15*a* and 16*a*. The left 15 and right 16 coaxial cylinders respectively contain a first piston 18 and a second piston 19. The pistons are mechanically connected by a common piston rod 20 that extends sealingly through the partition 17. The pistons 18 and 19 and the piston rod 20 are movable as a single unit in the axial directions of the cylinders 15 and 16.

The interior of the left cylinder 15 is divided by the first piston 18 into a left inner chamber 21 and a left outer chamber 22. The left inner chamber 21 is the volume between the first piston 18 and the partition 17, and the left outer chamber 22 is the volume between the first piston 18 and the end cap 15*a* of the left cylinder 15.

Similarly, the right cylinder 16 is divided by the second piston 19 into a right inner chamber 23 and a right outer chamber 24. The right inner chamber 23 is the volume between the second piston 19 and the partition 17, and the right outer chamber 24 is the volume between the second piston 19 and the end cap 16*a* of the right cylinder 16.

The mains water pipeline 2 is connected to both left and right inner chambers 21 and 23 via two separate connections 24 and 25, with respective non-return valves to prevent cross-flow from one inner chamber to the other. The non-return the valves permit water to enter the left and right inner chambers 21 and 23 from the pipeline 2. The left inner chamber 21 is connected to an inlet 56 of the right carbonator 11 via a non-return valve 28 which permits water to flow from the left inner chamber 21 to the carbonator 11, and similarly the right inner chamber 23 is connected to an inlet 53 of the left carbonator 10 via a non-return valve 27. Thus, as will be explained in more detail below, the inner chambers 21, 23 are able to receive uncarbonated water from the mains water supply and deliver uncarbonated water to the left and right carbonators 10 and 11.

The left outer chamber 22 of the volumetric control unit 9 has a port 22*a* connected by a duct 22*b* to the left servo valve 12. The servo valve 12 has a discharge position, in which the flow from the left outer chamber 22 via the port 22*a* and the duct 22*b* is directed to the dispense line 5, which leads to the tap 8, preferably through a further non-return valve (not shown). The servo valve 12 also has a recharge position, in which the outlet 54 of the left carbonator 10 is connected to the left outer chamber 22 via the duct 22*b* and the port 22*a*.

Similarly, the right outer chamber 24 of the volumetric control unit 9 has a port 24*a* connected by a duct 24*b* to the right servo valve 13. The right servo valve 13 has a discharge position, in which the flow from the right outer chamber 24 via the port 24*a* and the duct 24*b* is directed to the dispense line 5, which also leads to the tap 8, optionally through a further non-return valve (not shown). The servo valve 13 also has a recharge position, in which the outlet 57 of the right carbonator 11 is connected to the right outer chamber 24 via the duct 24*b* and the port 24*a*. Thus, as will be explained in more detail below, the outer chambers 22, 24 are able to receive carbonated water from the left and right carbonators 10 and 11, and deliver carbonated water to the discharge outlet 5.

In the illustrated embodiment both the left and right servo valves 12 and 13 are actuated by the water supply pressure. Each servo valve comprises a piston chamber 29, 30 and a spool chamber 31, 32 separated by a fixed partition 33, 34. The left and right spool chambers each have three ports. The first ports 31*a*, 32*a* are connected respectively to the ducts 22*b*, 24*b* leading to the left and right outer chambers 22, 24. The second ports 31*b*, 32*b* are connected respectively to the dispense line 5. The third ports 31*c*, 32*c* are connected respectively to the outlet 54 of the left carbonator 10 and to the outlet 57 of the right carbonator 11.

The piston chambers 29, 30 of servo valves 12 and 13 each have an inlet port 29*a*, 30*a* and contain a respective piston 35, 36 and a spring 37, 38 positioned between the piston 35, 36 and the partition 33, 34. Piston rods 39, 40 mechanically connected to the pistons 35, 36 extend through the respective partitions 33, 34 into the respective spool chambers 31, 32. The spool chambers each contain a valve spool 41, 42 attached to the piston rod. The valve spools 41, 42 each have a first spool end 43, 44 and a second spool end 45, 46 that control the flow through the spool chamber.

The operation of right servo valve 13 will now be described in detail. The operation of left servo valve 12 is similar, and is omitted for brevity. When water pressure is applied to piston chamber 30 via the inlet port 30*a*, the piston 36 moves to the right, compressing the spring 38. The movement of the piston 36 causes the spool 42 to move to the position shown in FIG. 2*a*, the discharge position. The spool ends 44 and 46 are spaced such that second spool end 46 blocks flow from the third port 32*c* to the first port 32*a*, while first spool end 44 is positioned to permit flow from the first port 32*a* to the second port 32*b*.

When the pressure in the piston chamber 30 is reduced, the spring 38 pushes the piston 36 to the left, to the recharge position. In the recharge position, the spool 42 is positioned so that the first spool end 44 blocks flow from the first port 32*a* to the second port 32*b*, while the second spool end 46 is positioned to permit flow from the third port 32*c* to the first port 32*a*.

Flow of water to and from the cylinders 30 and 31 of servo valves 12, 13 is controlled by the two-position slide valve 14. The two-position slide valve 14 is movable between a first position (seen in FIG. 2*a*) in which water pressure is supplied to the right servo valve 13 and the port 29*a* of the left servo valve 12 is connected to drain, and a second position (seen in FIG. 2*b*), in which water pressure is supplied to the left servo valve 12, and the port 30*a* of the right servo valve 13 is connected to drain.

The slide valve 14 is moved between its first and second positions by adjustable stops 47 mounted to the end of the common piston rod 20 engaging with abutments 47*a* and 47*b* attached to slide valve 14. The adjustable stops 47 are spaced such that when the common piston rod 20 approaches each end of its travel, one of the adjustable stops 47 pushes one of the abutments 47*a* and 47*b* of the slide valve 14. In the embodiment shown, movement of the piston rod 20 to its leftmost position places the slide valve 14 in its first position, and movement of the piston rod 20 to its rightmost position places the slide valve 14 in its second position. A lost motion between stops 47 and the abutments 47*a* and 47*b* ensures that the slide valve 14 changes position only during the very end of the travel of the piston rod 20. The mains water pipeline 2 is connected via a duct 48*a* and port 48*b* to a chamber 48 containing the slide valve 14 thereby providing water at mains pressure to the chamber.

The slide valve chamber 48 has three ports on its upper side, the left port 49 is connected to the inlet 29*a* of the left servo valve 12, the central port 50 is connected to the dispense line and the right port 51 to the inlet 30*a* of the right servo valve 13. The slide valve 14 is configured to cover two adjacent ports, isolating the two covered ports from the chamber 48 and connecting them together. The port 48*b* on the lower side of chamber 48 admits pressurised water from the supply via duct 48*a*.

When in the first position, the slide valve 14 covers and connects together the left port 49 and central port 50. The inlet 29*a* of the left servo valve 12 is connected to the dispense line 5, and therefore the left servo valve 12 is put in the recharge position. The right port 51 is connected to the mains water pipeline 2 and therefore the piston chamber 30 of the right servo valve 13 fills with mains water, putting the right servo valve 13 in the discharge position.

When moved to the second position, slide valve 14 covers the central port 50 and right port 51, connecting the inlet 30*a* of the right servo valve 13 to the dispense line 5. The right servo valve 13 is put in the recharge position and any mains water in the piston chamber 30 of the right servo valve 13 is discharged through the dispense line 5. The left port 49 is connected to the mains water pipeline 2 and therefore the piston chamber 29 of the left servo valve 12 fills with water, putting the left servo valve 12 in the discharge position.

In the illustrated embodiment the left 10 and right 11 carbonators are both "Isoworth"-type carbonators. They operate in the manner already described. The left carbonator 10 comprises a left $CO_2$ inlet 52, a left recharge inlet 53 and a left discharge outlet 54. Similarly the right carbonator 11 further comprises a right $CO_2$ inlet 55, a right recharge inlet 56 and a right discharge outlet 57.

The left $CO_2$ inlet 52 is connected to the $CO_2$ pipeline 4, the left recharge inlet 53 is connected to the right inner chamber 23 of the volumetric control unit 9 and the left discharge outlet 54 is connected to the third port 31*c* of the left servo valve 12. Similarly, the right $CO_2$ inlet 55 is connected to the $CO_2$ pipeline 4, the right recharge inlet 56 is connected to the left inner chamber 21 of the volumetric control unit 9 and the right discharge outlet 57 is connected to the third port 32*c* of the right servo valve 13. The operation of the left 12 and right 13 servo valves has already been described above and will not be repeated here.

Operation of the drinks dispensing system of FIG. 1 will now be described with reference to FIGS. 2*a* to 2*e*.

Referring firstly to FIG. 1, the flow control valve 7 for the $CO_2$ pipeline 4 is opened by an operator allowing $CO_2$ to flow into the carbonation unit 1. Then the dispense tap 8 is opened by the operator.

Referring now to FIG. 2*a*, the carbonation unit 1 is shown in an initial state. In the illustrated embodiment all of the inner and outer chambers 21, 23 22, 24 are empty. The left and right carbonators 10 11 are filled with $CO_2$ but contain no water. In the illustrated embodiment the rotors of both carbonators 10, 11 are assumed to run continuously.

As shown in FIG. 2*a* the common piston rod 20 is positioned having just completed a stroke to the left and the adjustable stops 47 have pushed the slide valve 14 into the first position. Although this is the initial state shown in the illustrated embodiment it should be clear that the carbonation unit can be started with the piston rod and slide valve in other positions.

When the mains water flow control valve 6 is opened water flows into the slide valve chamber 48 via duct 48*a*. The slide valve 14 is in the first position so the right port 51 is uncovered allowing water to flow into the piston chamber 30 of the right servo valve 13 so that the right servo valve is placed in the discharge position. The inlet 29*a* of the left servo valve 12 is connected to the discharge line via the left and central ports 49, 50 of the slide valve 14, and is therefore in the recharge position.

The left outer chamber 22 of the volumetric control unit 9 is connected to the left carbonator 10 which is at gas pressure PG. The left inner chamber 21 is connected to the right carbonator 11 which is also at gas pressure, but the non-return valve 28 prevents the gas pressure from reaching the left inner chamber 21. A pressure difference thus exists across the left piston 18, urging the piston and piston rod assembly to the right.

The right outer chamber 24 is connected to the dispense line 5 which is at atmospheric pressure and the right inner chamber 23 is connected to the recharge inlet 53 of the left carbonator 10 which is also at gas pressure, but the non-return valve 27 prevents the gas pressure from reaching the right inner chamber 23. Water flows into the right inner chamber 23 and fills it, as gas pressure in left outer chamber 22 additionally urges the piston and piston rod assembly to move to the right. Pressure in left inner chamber 21 rises as piston 18 moves to the right until it is equal to the pressure in right carbonator 11. The mains water pressure is insufficient to open the non-return valve 27, and therefore no water flows from the right inner chamber 23 into the left carbonator 10.

When the right inner chamber 23 is filled with water and the common piston rod 20 reaches its rightmost position, the right adjustable stop 47 on the end of the common piston rod 20 engages abutment 47*b* of the slide valve, and pulls the slide valve 14 from the first position to the second position.

FIG. 2*b* shows the carbonation unit 1 just after the piston rod 20 has completed its stroke to the right, with the right inner chamber 23 now filled with uncarbonated water. The slide valve 14 is in the second position, covering the central and right ports 50 and 51. The inlet 30*a* of the right servo valve 13 is now connected to the dispense line 5. The water in the piston chamber 30 of the right servo valve 13 is discharged through the dispense line 5 and the right servo valve 13 therefore returns to the recharge position. The left port 49 of slide valve 14 is now uncovered and allows mains water to flow to the inlet 29*a* of the left servo valve 12. The piston chamber 29 of the left servo valve 12 fills with water and the left servo valve 12 moves to the discharge position.

Now the left outer chamber 22 is connected to the dispense line 5 and is at atmospheric pressure. The right outer chamber 24 is now connected to the discharge outlet 57 of the right carbonator 11 which is at gas pressure. The pressure difference across the piston and cylinder assembly moves the assembly to the left.

Water now flows into the left inner chamber 21 from the mains water pipeline 2. The water in the right inner chamber 23 is forced through the non-return valve 27 and fills the left carbonator 10. The contents of right carbonator 11 are drawn into the right outer chamber 24, and the contents of left outer chamber 22 are discharged to the discharge line 5.

When the piston assembly reaches the rightmost end of its travel, abutment 47*b* is engaged by the adjustable stop 47 at the end of piston rod 20, and slide valve 14 is moved to its second position. At this point, the left outer chamber 22 is filled with carbonating gas, and the right inner chamber 23 is filled with uncarbonated water.

FIG. 2*b* illustrates the first return stroke to the left of the piston and piston rod assembly.

Referring now to FIG. 2*b*, the movement of the slide valve 14 to its second position causes the left servo valve 12 to move to its discharge position, and the right servo valve 13 to move to its recharge position.

The gas pressure in carbonator 11 is applied to the right outer chamber 24, and movement of the piston assembly to the left causes the water in the right inner chamber 23 to be delivered to the left carbonator 10. Mains water is admitted to the left inner chamber 21, and the contents of left outer chamber 22 are discharged to the discharge line 5.

When the piston assembly reaches the leftmost end of its travel, abutment 47*a* is engaged by the stop 47 at the end of piston rod 20, and the slide valve 14 is moved back to its first position. At this point, left inner chamber 21 is filled with uncarbonated water, left carbonator 10 is filled and carbonates its charge, and the right outer chamber 24 is filled with carbonating gas.

FIG. 2*c* illustrates the next stroke of the piston assembly to the right, the return of the slide valve 14 to its first position having caused the right servo valve 13 to move to its discharge position and the left servo valve 12 to move to its recharge position.

During this stroke of the piston assembly, the left outer chamber 22 is filled with carbonated water from the left carbonator 10, at gas pressure. The left inner chamber 21 delivers uncarbonated water to the right carbonator 11, the right inner chamber 23 fills with uncarbonated water from the mains inlet 26, and the right outer chamber 24 discharges its contents to the discharge line 5.

When the piston assembly reaches the rightmost end of its stroke, the stop 47 engages the abutment 47*b* and returns the slide valve 14 to its second position.

The next stroke of the piston assembly, to the left, is illustrated in FIG. 2*d*. During this stroke, carbonated water in left outer chamber 22 is delivered to the delivery line 5 and dispensed through the tap 8. The left inner chamber 21 refills with uncarbonated water from the mains, through inlet 25. The right inner chamber 23 discharges uncarbonated water to refill the left carbonator 10, while carbonated water from the right carbonator 11 is drawn into the right outer chamber 24. At the end of this stroke, the left inner chamber 21 and the right outer chamber 24 are filled with uncarbonated and carbonated water, respectively, and the left carbonator 10 is filled with water undergoing carbonation, while the right carbonator 11 contains only carbonating gas.

The next stroke of the piston assembly, to the right, is illustrated in FIG. 2*e*. During this stroke, carbonated water in the left carbonator 10 is drawn into the left outer chamber 22, while uncarbonated water in the left inner chamber 21 is delivered to the right carbonator 11. The right inner chamber 23 fills with uncarbonated water, while the right outer chamber 24 delivers carbonated water to the discharge line 5 and the tap 8.

At this point, the entire volumetric control unit 9 is filled with water, and the tap 8 can be closed. The system is now ready for instant delivery of carbonated water, since carbonated water will be available from one or other of the outer chambers 22 and 24 of the volumetric control unit 9, and the servo valves 12 and 13 will be correctly positioned to deliver the carbonated water to the discharge line 5 and to the tap 8.

The movement of the piston assembly 18, 19 and 20 is powered by the pressure difference across the assembly, one end of the assembly being exposed to carbonator gas pressure while the other end is at atmospheric pressure, when the tap 8 is opened. Clearly, when the tap 8 is closed, the gas pressure in one outer chamber of the volumetric control unit 9 is transmitted to the other by the free movement of the piston assembly within the cylinders 15 and 16. Any undispensed carbonated water is therefore held at carbonator pressure, retaining the carbonating gas in solution. Movement of the piston assembly is assisted by the mains water pressure in one or other of the inner chambers 21 and 23.

One complete stroke of the piston assembly from end to end causes one of the cylinders to fill one of the carbonators with uncarbonated water while receiving carbonated water from the other carbonator, while the other cylinder is filled with uncarbonated water from mains supply and simultaneously delivers carbonated water to the tap. It will be clearly appreciated that, if the cylinders 15 and 16 are of equal cross-sectional area, the amount of carbonated water discharged from the outer chamber of one cylinder will be the same as the amount of carbonated water drawn into the outer chamber of the other cylinder from its respective carbonator. Preferably, the volume of each cylinder 15, 16 is substantially equal to the volume of one of the carbonators 10 and 11, so that at every stroke one of the carbonators is completely charged and the other is completely emptied. Whenever the piston assembly is at an end of a stroke, one of the carbonators will have just been charged from an inner chamber of the control unit 9, and the other will be empty, having just discharged its contents into an outer chamber of the control unit 9.

The control of the flow of liquid through the system in the illustrated embodiment is achieved by servo-operated valves powered from the mains water pressure, control of the valves are being effected by the movement of the piston assembly. It will however be appreciated that, as an alternative to the slide valve 14 and servo-operated valves 12 and 13, electromechanical valves may be used to connect the outer chambers 22 and 24 to the dispense tap 8 or to a carbonator. The electromechanical valves may be controlled by a control circuit which includes a piston sensor to detect the position of the piston assembly 18, 19, 20 and which operates the electromechanical valves to make the fluid connections as described in relation to the embodiment. The piston sensor may detect the presence of the piston assembly at the respective ends of its stroke, and cause the control circuitry to operate the electromagnetic valves to make the fluid communications as described above. It is further foreseen that the servo valves 12 and 13 may be incorporated in a single valve block with a common spool and a single actuator, and the slide valve 14 of the illustrated embodiment may be replaced by a simple "on-off" valve, the valve being arranged to open, to supply mains water pressure to the servo motor, when the piston assembly reaches one end of its travel and while the piston moves towards the other end of its travel, and to stop the supply and vent the servo motor when the piston assembly reaches the other end of its travel and while of the piston assembly moves towards the one end of its travel.

The volumetric control unit 9 of the illustrated embodiment includes piston rod extensions which pass through the end caps 15*a* and 15*b* of the cylinders. These piston rod extensions may be used either to control or to drive metering pumps, for example for dosing flavouring syrups into the discharged carbonated water to produce a flavoured drink. Since the movement of the piston assembly, and therefore the piston rod, is directly proportional to the volume of carbonated water dispensed, the metering pump may be arranged to deliver syrup in proportion to the movement of the piston rod. Such an arrangement will ensure a correct proportioning of the syrup to the carbonated water. A plurality of syrup pumps may be provided, together with a selection device operable to selectively connect one or more of the plurality of syrup pumps with the piston rod so that the movement of the piston rod either operates the selected syrup pump or causes the selected syrup pump to deliver syrup to the carbonated water at the outlet.

While in the embodiment the carbonators 10 and 11 are described as "Isoworth"-type units with their agitating paddles continuously operated, it will be appreciated that the agitating paddles may be controlled so as to operate only when the piston assembly is moving, i.e. only when carbonated water is being dispensed and a carbonator is being refilled. It will also be appreciated that the carbonators 10 and 11 may be of a different type, comprising simply an enclosed volume with a gas injector nozzle at the lower part for bubbling gas through the water charge in the volume.

In an alternative embodiment of the carbonating apparatus, illustrated in FIG. 3, the servo valves 12 and 13 and the slide valve 14 are substituted by a valve assembly comprising two-position left and right carbonator valves 62 and 61 and a two-position discharge valve 60. In FIG. 3, components corresponding to elements shown in FIGS. 2*a*-2*e* are designated by the same reference numbers.

In the embodiment schematically illustrated in FIG. 3, the volumetric control unit 9 is divided into four internal chambers 22, 21, 23 and 24 as before. The left inner chamber 21 is connected to the carbonator 11 through a non-return valve 28 as before, and the right inner chamber 23 is connected to the carbonator 10 through a non-return valve 27. Mains water is fed from the supply pipeline 2 to the left and right inner chambers 21 and 23, through the non-return valves 25 and 26.

The right outer chamber 24 is connected to the right carbonator 11 via the two-position right carbonator valve 61. The right carbonator valve 61 comprises an input port 61*a* connected to the right carbonator 11 by a duct 24*b*, and an output port 61*b* connected to the right outer chamber 24.

The right carbonator valve 61 has a discharge position, as shown in FIG. 3, in which the input port 61*a* is connected to the output port 61*b* thereby allowing water to flow from the right carbonator 11 to the right outer chamber 24. The right carbonator valve 61 also has a cut-off position, as shown in FIG. 3*a*, in which the input port 61*a* is not connected to the output port 61*b*, thereby isolating the right outer chamber 24 from the right carbonator 11.

Similarly, the left outer chamber 22 is connected to the left carbonator 10 via the two-position left carbonator valve 62. The left carbonator valve 62 comprises an input port 62*a* connected to the left carbonator 10 by a duct 22*b*, and an output port 62*b* connected to the left outer chamber 22. The left carbonator valve 62 has a discharge position in which the input port 62*a* is connected to the output port 62*b* allowing water to flow from the left carbonator 10 to the left outer chamber 22. The left carbonator valve 62 also has a cut-off position in which the input port 62*a* is not connected to the output port 62*b*, thereby isolating the left outer chamber 22 from the left carbonator 10.

The two-position discharge valve 60 has two inlet ports 60*a* and 60*b*, and a single outlet port 60*c*. Inlet port 60*a* is connected to the right outer chamber 24 and similarly, inlet port 60*b* is connected to the left outer chamber 22.

The two-position discharge valve 60 and the left and right carbonator valves 62 and 61 are mechanically connected (not shown) to form the valve assembly. The valve assembly is configured so that when the discharge valve 60 is in a first position, shown in FIG. 3, the left carbonator valve 62 is in its cut-off position and the right carbonator valve 61 is in its discharge position. The valve assembly is configured so that when the discharge valve 60 is moved to its second position, shown in FIG. 3*a*, the left carbonator valve 62 is moved to its discharge position and the right carbonator valve 61 is moved to its cut-off position.

In the first position of the discharge valve 60, shown in FIG. 3, the left outer chamber 22 is connected to the outlet port 60*c* and discharges its contents through the discharge valve 60 until the chamber 22 is empty, moving the piston assembly to the left. The left carbonator valve 62 is in the cut-off position isolating the left carbonator 10 from the left outer chamber 22 and thereby preventing the left carbonator 10 from venting $CO_2$ through the chamber 22 and the outlet port 60*c*. Simultaneously, uncarbonated water is drawn into chamber 21 through valve 25, uncarbonated water is supplied from chamber 23 to carbonator 10 through valve 27, and carbonated water is drawn from carbonator 11 into chamber 24 via the right carbonator valve 61 which is in its discharge position. The piston assembly then remains at the left-hand end of its travel until the discharge valve 60 is moved to its second position, shown in FIG. 3*a*.

In the second position of the discharge valve 60, shown in FIG. 3*a*, the right outer chamber 24 is connected to the outlet port 60*c* and discharges its contents through the discharge valve 60 until the chamber 24 is empty, moving the piston assembly to the right. The right carbonator valve 61 is in its cut-off position isolating the right carbonator 11 from the right outer chamber 24 and thereby preventing the right carbonator 11 from venting $CO_2$ through the chamber 24 and the outlet port 60*c*. Simultaneously, uncarbonated water is drawn into right inner chamber 23 through valve 26, uncarbonated water is supplied from left inner chamber 21 to carbonator 11 through valve 28, and carbonated water is drawn from carbonator 10 into left outer chamber 22 via the left carbonator valve 62 which is in its discharge position. The piston assembly then remains at the right-hand end of its travel until the discharge valve 60 is returned to its first position.

In one embodiment, the position of the discharge valve 60 is moved manually by a human operator, such that, upon dispensing the entire contents of the outer chamber 22 or 24 with the discharge valve 60 in one position, the operator must move the discharge valve 60 to its other position in order to continue discharging carbonated water.

The apparatus illustrated in FIGS. 3 and 3*a* is simplified in terms of its requirements for valves as compared to the previously-described embodiment, but has the limitation that it dispenses the entire contents of the outer chamber 22 or 24 at each operation of the valve 60 as a single portion of carbonated water. By modifying the valve 60 to add a holding position, in which neither of the inlet ports 60*a* nor 60*b* is connected to the outlet port 60*c*, delivery of the carbonated water can be interrupted before the piston assembly reaches its end position, by moving the valve 60 to the holding position.

FIGS. 4*a* to 4*e* illustrate a valve arrangement for a carbonator similar to the valve arrangement shown in FIGS. 3 and 3*a*, modified so that the discharge valve 60 has three operating positions.

In the embodiment illustrated in FIGS. 4*a* to 4*e* the discharge valve 60 has a central holding position between the first and second positions, such that a user can move the valve 60 to the holding position from either the first or second positions. A discharge valve 60 is again linked to the left and right carbonator valves 62 and 6 as in the embodiment described in relation to FIGS. 3 and 3*a*, but in this embodiment in the linkage includes a lost motion mechanism.

In the exemplary embodiment, left and right carbonator valves 62 and 61 are moved between their respective positions by a stop 63 situated the end of a rod 64 fixed to the discharge valve 60 which engages with one or other of two abutments 63*b* and 63*c* attached to the left and right carbonator valves 62 and 61. The abutments 63*b* and 63*c* are spaced such that when the discharge valve is moved from its the central holding position to one of its end positions, rod 64 and its stop 63*a* engages one of the carbonator valve abutments 63*b* and 63*c* and moves the carbonator valves to appropriate positions for that end position of the discharge valve.

The lost motion between the discharge valve stop 63*a* and the carbonator valve abutments 63*b* and 63*c* ensures that the left and right carbonator valves 62 and 61 only change their respective positions when the discharge valve 60 is moved to the end position it did not previously occupy. In other words, moving the discharge valve from an end position to the holding position and then back to the previously-occupied end position will not cause the position of the carbonator valves to be changed.

Operation of the valve assembly will now be described with reference to FIGS. 4*a* to 4*e*.

Figure 4A:
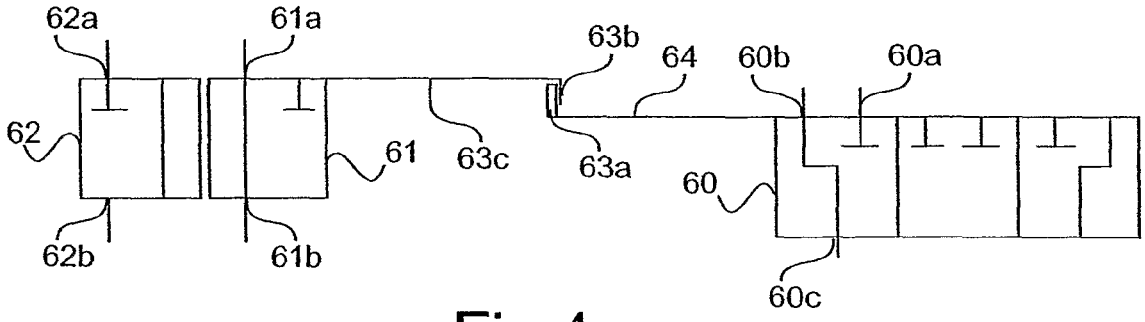

FIG. 4*a* shows the valve assembly in an initial configuration in which the discharge valve 60 is in its first position, the left carbonator valve 62 is in its discharge position, the right carbonator valve 61 is in its cut-off position and the discharge valve stop 63*a* is adjacent to the right abutment 63*b*. The left outer chamber 22 is connected to the outlet port 60*c* and carbonated water is being discharged moving the piston assembly to the left. While the valve assembly remains in this configuration carbonated water will continue to be dispensed from the left outer chamber until it is empty. However, if a full charge of carbonated water from the left outer chamber 22 is not required then the operator can move the discharge valve 60 to the holding position to stop dispensing from the left outer chamber 22.

Figure 4B:
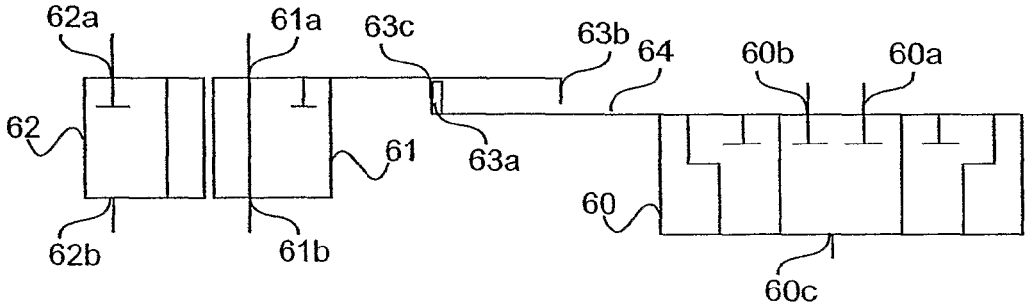

When the discharge valve 60 is moved from its first position to its holding position, the valve assembly is placed in the configuration shown in FIG. 4*b*, with neither of the discharge valve inlets 60*a* or 60*b* connected to the outlet valve 60*c*. No carbonated water is dispensed from the outer chambers 22 and 24 and the piston assembly is stationary. The discharge valve stop 63*a* is now positioned adjacent the left abutment 63*c* but the left and right carbonator valves 62 and 61 remain in their previous cut-off and discharge positions respectively.

Moving the discharge valve 60 back to its first position will return the valve assembly to the configuration shown in FIG. 4*a* and carbonated water will continue to be dispensed from the left outer chamber 22 until either it is empty or the discharge valve 60 is returned to its holding position.

Figure 4C:
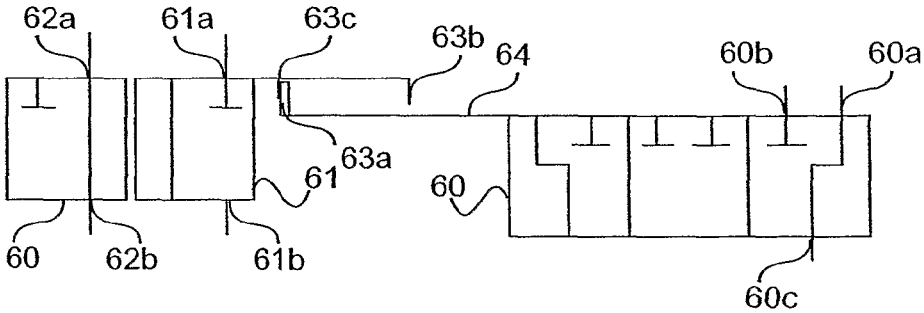

Alternatively, the operator can move the discharge valve 60 from the holding position to its second position, to place the valve assembly in the configuration shown in FIG. 4*c*. Upon moving the discharge valve 60 from its holding position to its second position, the discharge valve stop 63*a* pushes the adjacent left abutment 63*c* moving the left and right carbonator valves 62 and 61 to their discharge and cut-off positions respectively. As the discharge valve 60 is in its second position, the right outer chamber 24 is connected to the outlet port 60*c* and carbonated water is discharged therefrom, moving the piston assembly to the right. Carbonated water will continue to be dispensed from the right outer chamber 24 until either the chamber 24 is empty or the discharge valve 60 is moved back to its holding position.

Figure 4D:
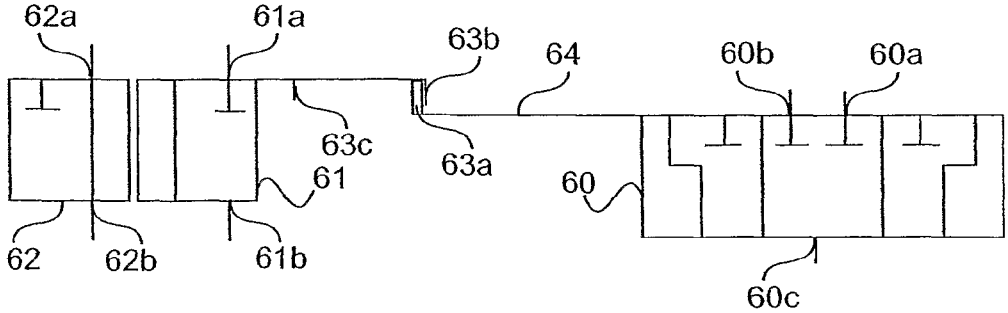

Moving the discharge valve 60 back to its holding position puts the valve assembly in the configuration shown in FIG. 4*d* in which neither of the discharge valve inlets 60*a* or 60*b* are connected to the outlet 60*c*. No carbonated water is dispensed and the piston assembly is stationary. The discharge valve stop 63*a* is now adjacent to the right abutment 63*b* but the left and right carbonator valves 62 and 61 are not moved, and remain in their discharge and cut-off positions respectively.

Moving the discharge valve 60 back to its second position from its holding position will return the valve assembly to the configuration shown in FIG. 4*c* and carbonated water will continue to be dispensed from the right outer chamber 24 until either it is empty or the discharge valve 60 is returned to its holding position.

Alternatively the discharge valve 60 can be moved from the holding position to its first position, which places the valve assembly back into the configuration shown in FIG. 4*a*. Upon moving the discharge valve 60 from its holding position to its first position the discharge valve stop 63*a* pushes the adjacent right abutment 63*b* moving the left and right carbonator valves 62 and 61 to their cut-off and discharge positions respectively. Carbonated water is dispensed from the left outer chamber 22 either until the chamber is empty or the discharge valve 60 is moved to its holding position The three-position discharge valve 60 shown in FIG. 4 may be a manually operated valve, resiliently biased towards its central holding position. In use, the operator will move the discharge valve from its holding position to an end position to discharge carbonated water. If the flow of water ceases before the user's requirement is met, due to the selected outer chamber 22 or 24 becoming empty, then the user simply moves the discharge valve back through the holding position to its other end position to continue discharging carbonated water from the other outer chamber 24 or 22. When sufficient carbonated water has been dispensed, the user releases the valve and the resilient bias returns the valve to its central holding position.

Alternatively, the three-position discharge valve may be unbiased, and simply remain in the position into which it was last put. If the discharge valve is left in an end position, carbonated water will continue to be discharged until the outer chamber 22 or 24 is empty, whereupon flow will cease.

In a further alternative, the three-position discharge valve may be electrically controlled to move between its holding position and its end positions by a control circuit which is arranged to move the valve to an end position on the basis of a control input from a user. The control circuitry may be arranged so that the entire contents of one outer chamber 22 or 24 are discharged, either as a single portion or as a plurality of smaller doses, before the three-position valve is moved to its other end position to discharge carbonated water from the other outer chamber. The control circuitry may include a piston position sensor to detect when the piston reaches each end of its travel, and a programmable means such as a processor to control the movement of the discharge valve in accordance with a user control input and the information from the piston position sensor.

In the embodiment where the discharge valve is electrically controlled, the carbonator valves may also be electrically controlled, with the linkage between the operation of the discharge valve and the movement of the carbonator valves being effected by the control circuitry.

The invention claimed is:

1. An apparatus for producing a supply of carbonated water, comprising:

supply means (2) for receiving a supply of uncarbonated water;

discharge means (5, 8) for discharging carbonated water;

a first carbonating unit (10) having a charging inlet (53) for uncarbonated water and a delivery outlet (54) for carbonated water;

a second carbonating unit (11) having a charging inlet (56) for uncarbonated water and a delivery outlet (57) for carbonated water;

a volumetric control unit (9) operable in a first mode:

to deliver a volume of carbonated water to the discharge means (5), to receive a like volume of carbonated water from the delivery outlet (54) of the first carbonating unit, to receive a like volume of uncarbonated water from the supply means (2), and to deliver a like volume of uncarbonated water to the second carbonating unit (11); and operable in a second mode:

to deliver a volume of carbonated water to the discharge means (5), to receive a like volume of carbonated water from the delivery outlet (57) of the second carbonating unit, to receive a like volume of uncarbonated water from the supply means (2), and to deliver a like volume of uncarbonated water to the first carbonating unit (10).

2. An apparatus according to claim 1, wherein the volumetric control unit comprises first, second, third and fourth internal chambers (22, 21, 23, 24) of variable volume wherein the sum of the volumes of the first and second chambers (22, 21) is equal to the sum of the volumes of the third and fourth chambers (23, 24), and wherein;

the first chamber (22) is selectively connectable to the discharge means (5, 8) or to the outlet (54) of the first carbonating unit (10);

the second chamber (21) is arranged to receive water from the water supply means (2) and is adapted to discharge water to the inlet (56) of the second carbonating unit (11);

the third chamber (23) is arranged to receive water from the water supply means (2) and is adapted to discharge water to the inlet (53) of the first carbonating unit (10); and the fourth chamber (24) is selectively connectable to the discharge means (5, 8) or to the outlet (57) of the second carbonating unit (11);

the arrangement being such that when the first chamber (22) is connected to the discharge means (5, 8), the fourth chamber is connected to the outlet (57) of the second carbonating unit (11), and when the fourth chamber is connected to the discharge means (5, 8), the first chamber is connected to the outlet (54) of the first carbonating unit (10).

3. An apparatus according to claim 2, wherein the volumetric control unit comprises first and second piston and cylinder assemblies (15, 18; 16, 19), the first and second chambers (22, 21) being defined by the volumes of the first cylinder (15) on respective sides of the first piston (18), and the third and fourth chambers (23, 24) being defined by the volumes of the second cylinder (16) on respective sides of the second piston (19), the first and second cylinders being of substantially equal cross-section, and the first and second pistons being linked by a common piston rod (20).

4. An apparatus according to claim 3, wherein the selective connection between the first chamber (22) and the discharge means (5, 8) or the outlet (54) of the first carbonating unit (10) is made by means of a first servo-operated valve (12), and the selective connection between the fourth chamber (24) and the discharge means (5, 8) or the outlet (57) of the second carbonating unit (11) is made by means of a second servo-operated valve (13), and wherein control means (14) responsive to the position of the piston rod (20) are arranged to operate the first and second servo valves (12, 13).

5. An apparatus according to claim 4, wherein the first and second servo valves (12, 13) are operated by water pressure, and the control means (14) comprises a slide valve operable in a first position to supply water pressure to one servo valve and to vent the other servo valve, and in a second position to supply water pressure to other servo valve and to vent the one servo valve, the slide valve being movable from its first position to its second position and vice versa in response to movement of the piston rod (20).

6. An apparatus according to claim 4, wherein the first and second servo valves (12, 13) are electrically operated, and the control means (14) comprises a control circuit operable to actuate the servo valves, the control circuit being responsive to a sensor detecting the position of the piston rod (20).

7. An apparatus according to claim 3, wherein the piston rod (20) extends outside the pistons (15, 16), and wherein movement of the piston rod is adapted to drive or control a metering pump.

8. An apparatus according to claim 7, further comprising a plurality of metering pumps and a selector of mechanism for selecting one or more of said plurality of metering pumps, the selected one or more metering pumps being driveable or controllable by the movement of the piston rod.

9. An apparatus according to claim 2, further comprising a discharge valve (60), and wherein:

a first carbonator valve (62) which, when open, provides connection between the first chamber (22) and the outlet (54) of the first carbonating unit (10);

a second carbonator valve (61) which, when open, provides connection between the fourth chamber (24) and the outlet (57) of the second carbonating unit (11); and the discharge valve (60) in a first position provides communication between the first chamber (22) and the discharge means (60*c*), and in a second position provides communication between the second chamber (24) and the discharge means (60*c*);

and wherein the discharge valve (60) is linked to the first and second carbonator valves such that when the discharge valve (60) is in its first position, the first carbonator valve (62) is closed and the second carbonator valve (61) is open, and when the discharge valve is in its second position, the first carbonator valve (62) is open and the second carbonator valve (61) is closed.

10. An apparatus according to claim 9, wherein the discharge valve (60) has a third position in which neither the first (22) nor the second (24) chamber is connected to the discharge means (60*c*).

11. An apparatus according to claim 10, wherein the linkage between the discharge valve (60) and the first and second carbonator valves (62, 61) includes a lost motion device.

12. An apparatus according to claim 10 or claim 11, wherein the discharge valve is resiliently biased towards its third position.

13. An apparatus according to claim 9 or claim 10, wherein the discharge valve and the carbonator valves are moved by actuators controlled by a control circuit in response to a user input.

14. A method of providing a supply of carbonated water from a carbonation apparatus comprising: supply means (2) for receiving a supply of uncarbonated water;

discharge means (5, 8) for discharging carbonated water;

a first carbonating unit (10) having a charging inlet (53) for uncarbonated water and a delivery outlet (54) for carbonated water;

a second carbonating unit (11) having a charging inlet (56) for uncarbonated water and a delivery outlet (57) for carbonated water;

a volumetric control unit (9);

the method comprising operating the apparatus in a first mode to simultaneously deliver a volume of carbonated water from the volumetric control unit (9) to the discharge means (5), discharge a like volume of carbonated water from the delivery outlet (54) of the first carbonating unit to the volumetric control unit (9), to receive a like volume of uncarbonated water from the supply means (2) into the volumetric control unit (9), and to deliver a like volume of uncarbonated water from the volumetric control unit (9) to the second carbonating unit (11);

and subsequently operating the apparatus in a second mode to simultaneously deliver a volume of carbonated water from the volumetric control unit (9) to the discharge means (5), discharge a like volume of carbonated water from the delivery outlet (57) of the second carbonating unit into the volumetric control unit (9), to receive a like volume of uncarbonated water from the supply means (2) into the volumetric control unit (9), and to deliver a like volume of uncarbonated water from the volumetric control unit (9) to the first carbonating unit (10).

* * * * *